US006532970B2

(12) United States Patent
Phue

(10) Patent No.: US 6,532,970 B2
(45) Date of Patent: Mar. 18, 2003

(54) MAKE-UP CASE AND KIT

(76) Inventor: Jeanne Van Phue, 10017 Sully Dr., Sun Valley, CA (US) 91352

( * ) Notice: Subject to any disclaimer, the term of this patent is extended or adjusted under 35 U.S.C. 154(b) by 0 days.

(21) Appl. No.: 09/884,271

(22) Filed: Jun. 19, 2001

(65) Prior Publication Data

US 2002/0189631 A1 Dec. 19, 2002

(51) Int. Cl.[7] ..... A45D 33/24; A45D 33/26; A45D 33/00

(52) U.S. Cl. ..... 132/296; 132/294; 132/293

(58) Field of Search ..... 132/296, 294, 132/293, 295; 906/581, 235, 560

(56) References Cited

U.S. PATENT DOCUMENTS

| | | | | | |
|---|---|---|---|---|---|
| 1,515,812 | A | | 11/1924 | Lindon | |
| 1,601,892 | A | | 10/1926 | Thralls | |
| 1,607,985 | A | | 11/1926 | Johnson | |
| 1,714,732 | A | * | 5/1929 | Schneider | 132/296 |
| 1,766,478 | A | * | 6/1930 | Baker et al. | 132/296 |
| 1,774,171 | A | | 8/1930 | Coons | |
| 1,777,027 | A | | 9/1930 | D'Arlet | |
| 1,788,399 | A | | 1/1931 | McAtree | |
| 1,808,961 | A | | 6/1931 | Lyhne | |
| 2,017,722 | A | | 10/1935 | Magnus | 132/83 |
| 2,264,300 | A | | 12/1941 | Davies | 312/31 |
| 2,601,158 | A | | 6/1952 | MacGillivary | 132/83 |
| 3,006,350 | A | | 10/1961 | Grunfeld | 132/83 |
| 3,905,087 | A | * | 9/1975 | Leahy | 206/581 |
| 4,138,827 | A | | 2/1979 | Baugh et al. | 34/98 |
| 4,421,127 | A | | 12/1983 | Geer | 132/83 R |
| D275,900 | S | * | 10/1984 | Spector | D28/4 |
| 4,917,130 | A | | 4/1990 | Sweder | 132/288 |
| 5,005,697 | A | | 4/1991 | Jimbo et al. | 206/235 |
| 5,135,012 | A | | 8/1992 | Kamen et al. | 132/294 |
| 5,222,643 | A | | 6/1993 | Platt | 224/218 |
| 5,655,553 | A | | 8/1997 | Giese et al. | 132/303 |
| 5,813,420 | A | | 9/1998 | Sussman | 132/294 |
| 6,098,497 | A | | 8/2000 | Larose | 81/3.4 |
| D436,421 | S | * | 1/2001 | Cooper | D28/77 |

* cited by examiner

*Primary Examiner*—John J. Wilson
*Assistant Examiner*—Robyn Kieu Dean
(74) *Attorney, Agent, or Firm*—Ladas & Parry

(57) ABSTRACT

A make up case or kit comprises two hingedly connected compartments, a flat dividing element inserted between the compartments which is hingedly held in place, and a plurality of magnetic holders of the cosmetics supplies removably insertable inside the first compartment. The case is opened and closed by rotating either of the compartments about the hinge and the dividing element is rotatable about the hinge to cover either of the compartments. The case further includes a belt secured to a bottom of either of the compartments, the belt allowing to wear the case around a user's wrist, ankle or neck. In order to facilitate wearing of the case in such manner, the belt includes velcro sections.

1 Claim, 10 Drawing Sheets

MAKE-UP CASE AND KIT

BACKGROUND OF THE INVENTION

1. Field of the Invention

This invention generally relates to a field of cases or kits for housing and carrying a plurality of individual cosmetic containers. More specifically, the present invention relates to an improved compact case, which can be worn around the user's wrist or neck, wherein removable inserts, each containing a predetermined shade and/or type of cosmetic, can be securely held in place thereby providing the user with a variety of cosmetic materials from which to choose.

2. Description of the Related Art

Cosmetic materials available to the consumers in the market place are very numerous. The particular cosmetic assortment which an individual consumer purchases is entirely dependent upon that consumer's subjective preferences. A typical consumer of cosmetics normally desires an assortment of cosmetics which includes the desired colors, tints and hues to satisfy the consumer's preferences, in particular to fit and complement that consumer's facial characteristics, skin and hair color and condition, and even clothes. Additionally, various types of cosmetics may be desirable, for example, shadows, mascara, foundations, lipstick, powder, blush, lip gloss and so on.

A typical packaging of cosmetics supplies traditionally comprised pre-selected, fixed containers of cosmetic materials having a variety of both colors and types. However, individual users' tastes and needs vary widely, as noted above. Consequently, the cosmetics materials which do not suit a particular user's needs or taste would be inevitably wasted. This, of course, is costly to the consumer since the unused and wasted cosmetics are purchased together with desired cosmetics.

It is, therefore, highly desirable to ameliorate such squander, to alleviate the prodigal practices and to ensure that consumers will have at their disposal a complete array of only desired cosmetics. To accomplish this advantageous result, there is need to provide a cosmetic compact case wherein a matrix configuration is provided to accept a plurality of individual removable cosmetic inserts so as to establish a cosmetic palette.

There is, therefore, a need that the individual cosmetic inserts can be offered to the consumer independent of the compact case into which they will be positioned. Should such device be provided, consumers will be able to choose only those preferred cosmetics which are desirable for purchase and assemble them in a compact case so as to establish a personal and unique arrangement of cosmetics.

In order to securely hold the inserts in their predetermined matrix position, it is very beneficial to use the inserts made of magnetic materials.

Furthermore, it is desired that the case also include a centrally positioned divider, which can be a mirror. The divider would separate a powder section of the case from the section containing other supplies, such as eye shadows, lip color concealers, etc. Such design is especially desired by professional users of cosmetics, like professional actors and actresses, entertainers, musicians, and the like. Moreover, it is further beneficial to have a cosmetics case which can be worn around the user's wrist or neck, so as to be immediately available. A belt attached to the case, for example, a VELCRO™ belt or a belt having hook and loop fasteners, can be used for this purpose.

U.S. Pat. No. 1,808,961 to Lyhne describes a compact and puff holder for vanity boxes. The Lyhne device has two sections each capable of holding containers with cosmetic supplies. The two sections are separated by a mirror serving also as a divider between the two sections. Yet, the Lyhne device comprises no Velcro fastener, and it cannot be worn around the user's neck or wrist, but only in a handbag. Furthermore, the Lyhne device does not have magnetically held inserts. Instead, the trays in Lyhne are held in place by mechanical means, which is less efficient and less reliable than the magnetic holders.

U.S. Pat. No. 4,421,127 to Geer also describes a cosmetic case having interchangeable cosmetic inserts. This device also comprises a divider. However, the divider in the Geer device does not really separate different kinds of cosmetics. In Geer, they all are on one side and the purpose the lid serves is not to separate the inserts on either side of the lid, but rather to hold them in place and to prevent them from shifting. Geer uses no magnets to accomplish this goal.

U.S. Pat. No. 2,264,300 to Davies describes a case having two halves. The first half is designed to hold cleansing disks, wafers and the like which have to be kept moist. The second half is for holding cosmetic supplies. The two halves are separated by a mirror which also serves as a divider. However, in Davies, just as in Geer, all the cosmetic are located on the same side and no magnets to hold the cosmetic inserts in place are used. Davies does not even teaches that those inserts are replaceable.

U.S. Pat. No. 5,813,420 to Sussman describes a make-up kit having replaceable inserts. Each kind of cosmetic is held in a separate module, the contents of each are replaced upon exhaustion. However, this patent does not disclose any kind of a divider in the middle. Furthermore, Sussman does not disclose any magnets for holding the cosmetic modules in place.

U.S. Pat. No. 5,005,697 to Jimbo, et. al. describes a make-up case containing a number of cosmetic pans. The bottom of each pan is provided with a magnet and the pans are held in place magnetically. However, there is no divider of any kind described in this patent.

U.S. Pat. No. 5,135,012 to Kamen, et. al. describes a compact case and is somewhat alike the above-mentioned Jimbo patent. Kamen also uses magnets to hold cosmetic containers in place. In addition, the magnets are used to seal a joint between the lid and the base of the compact case. However, like in Jimbo, this patent describes no divider.

U.S. Pat. No. 3,006,350 to Grunfeld describes a vanity case. It is designed to be worn around a person's wrist thus simultaneously being a bracelet as well. However, Grünfeld does not teach using a divider inside the case. Nor is there any use of magnets to hold the cosmetic in place.

U.S. Pat. No. 5,655,553 to Giese, et. al. describes a cosmetic compact with cosmetic pans which can be removed, and with a mirror. The pans are held in place mechanically and are removed by applying pressure using mechanical means. This patent does not describe any magnetic devices for retaining the pans in place nor does it have a divider.

U.S. Pat. No. 2,601,158 to MacGillivary describes a combination of a wrist watch and a vanity case. The relevancy of this patent lies in the fact that this device can be worn around a woman's wrist. However, the make-up portion of the MacGillivary device has no magnetized receptacles and no divider in the middle and no provisions are described for replacing the contents of the cosmetic bins.

U.S. Pat. No. 1,788,399 to McAtree describes a vanity case having a centrally positioned mirror serving as a separator between two parts of the case. However, McAtree describes no various replaceable receptacles for different kinds of cosmetic nor any magnetic means for keeping the cosmetic in place.

U.S. Pat. No. 1,777,027 to D'Arlet describes a vanity case worn on a woman's wrist. D'Arlet describes a case with compartments for a few kinds of cosmetic accessories. However, this device has no divider and does not provide for replaceable trays holding cosmetic and held in place with magnets.

U.S. Pat. No. 1,774,171 to Coons describes another vanity case having a circular shape. This case comprises two similar circular portions, one serving as the cover and another—as the body of the case. Each carries powder compact. There is a mirror, but it is attached directly to one of the portions and is not in the middle of the device separating the portions. There are no compartments for other kinds of cosmetic, no central divider of any kind, no provisions for wearing the device and no magnetic devices for securing the cosmetic.

U.S. Pat. No. 1,607,985 to Johnson is similar to the above-described D'Arlet patent, and likewise describes a vanity case worn on a woman's wrist. Johnson describes a case with only two compartments for cosmetics. The case has a mirror on the lid. However, like in D'Arlet, this device has no divider and does not show replaceable containers holding cosmetic and held in place with magnets.

U.S. Pat. No. 1,601,892 to Thralls describes a vanity case having two portions—one for cosmetic supplies and the other—for carrying, for example, business cards or paper money bills. The two portions are separated by a mirror-divider. The presence of this mirror is a feature making the Thralls invention relevant. However, this divider is not used to separate different kinds of cosmetics supplies. Rather, it separates cosmetic supplies from non-cosmetic items such as cards or bills. Moreover, the Thralls invention does not describe features allowing to use replaceable trays for various cosmetic held in place with magnets.

U.S. Pat. No. 1,515,812 to Lindon describes a powder puff in a shape of oval. It comprises a lipstick holder. However, Lindon has no centrally located divider and no multiple receptacle for various cosmetic. The Lindon device is designed just for carrying powder and lipstick.

U.S. Pat. No. 2,017,722 to Magnus describes a combination of a cigarette case and a vanity case. It shows a device with two compartments, an upper compartment and a lower compartment. The lower compartment serves to hold powder, while the upper compartment contains cigarettes. This device is somewhat relevant because, when the case is open, a mirror separates the two compartments. However, the mirror separates cosmetic (powder) and non-cosmetic (cigarettes) items, similar to the device described in the above-mentioned patent to Thralls. And finally, there are no replaceable cosmetic bins or magnet-based elements to hold them in place.

Finally, U.S. Pat. No. 4,917,130 to Sweder describes a make-up kit mounted on a steering wheel of a vehicle using VELCRO™ or hook and loop fasteners. The Sweder patent only describes a way the kit is mounted on the steering wheel. It does not disclose any features describing how the kit itself is built.

Therefore, the review of prior art reveals that no known invention describes a make-up case having the following features:

1) a divider, which divider is preferably, but not necessarily, a mirror;
2) a belt securely attached to the case so that the case can either be worn by the user on her wrist or around her ankle or as a pendant on her neck. In order to allow for wearing the case in such manner, the terminal portions of the belt comprise a velcro material;
3) magnets for holding cosmetic supplies in the case. Yet a need to have a device comprising all these features is acute.

The device of the present invention, unlike all prior related art, shows all these features and satisfies all the needs discussed above.

SUMMARY OF THE INVENTION

The present invention is directed to a make-up case or kit comprising two sections. The first section includes a plurality of replaceable and interchangeable inserts-holders containing cosmetics supplies, such as eye shadows, lip color concealer, mascara, foundations, lipstick, blush, lip gloss, and the like (except powder). In the first section, a brush holder is also provided to keep a shadow brush, or a lip brush, or a combination brush, one side of which is a shadow brush and the other side—a lip brush. The inserts are made of a magnetic material and are attached to the bottom of the case magnetically.

The second section comprises a compartment for holding pressed (compact) powder. This compartment is also removable and can be replaced when the powder is used up. The second section is separated from the first section by a divider. The divider preferably, but not necessarily, comprises a mirror.

The bottom of the make-up case of this invention includes two slots in which a belt is secured. The belt is made of an elastic material and comprises VELCRO™, or hook and loop fastener portions, allowing the user to wear the case around his or her wrist or neck.

The gist of this invention is that the device described comprises three important features: the magnetic replaceable compartments for cosmetics, a central divider, and a belt so that the case can be worn around the user's wrist or neck thus maximizing the convenience of the use. No previously known device has all these three features. Therefore, the device of this invention is novel over prior art and is non-obvious in view of it.

According to a first aspect of the invention, a case for carrying and storing cosmetics supplies is provided, the case comprising two hingedly connected compartments, a flat dividing element inserted between the compartments which is hingedly held in place, and a plurality of magnetic holders of said cosmetics supplies removably insertable inside the first compartment, wherein the case is opened and closed by rotating either of the compartments about the hinge and the dividing element is rotatable about the hinge to cover either of the compartments.

According to another aspect of this invention, the case further includes a belt secured to a bottom of either of the compartments, the belt allowing one to wear the case around a user's wrist or neck, and in order to facilitate wearing of the case in such manner, the belt includes VELCRO™, or hook and loop fastener sections.

BRIEF DESCRIPTION OF THE DRAWINGS

The features and advantages of the present invention will become better understood with regard to the following description, appended claims, and accompanying drawings where

DETAILED DESCRIPTION OF THE INVENTION

Figure 1:
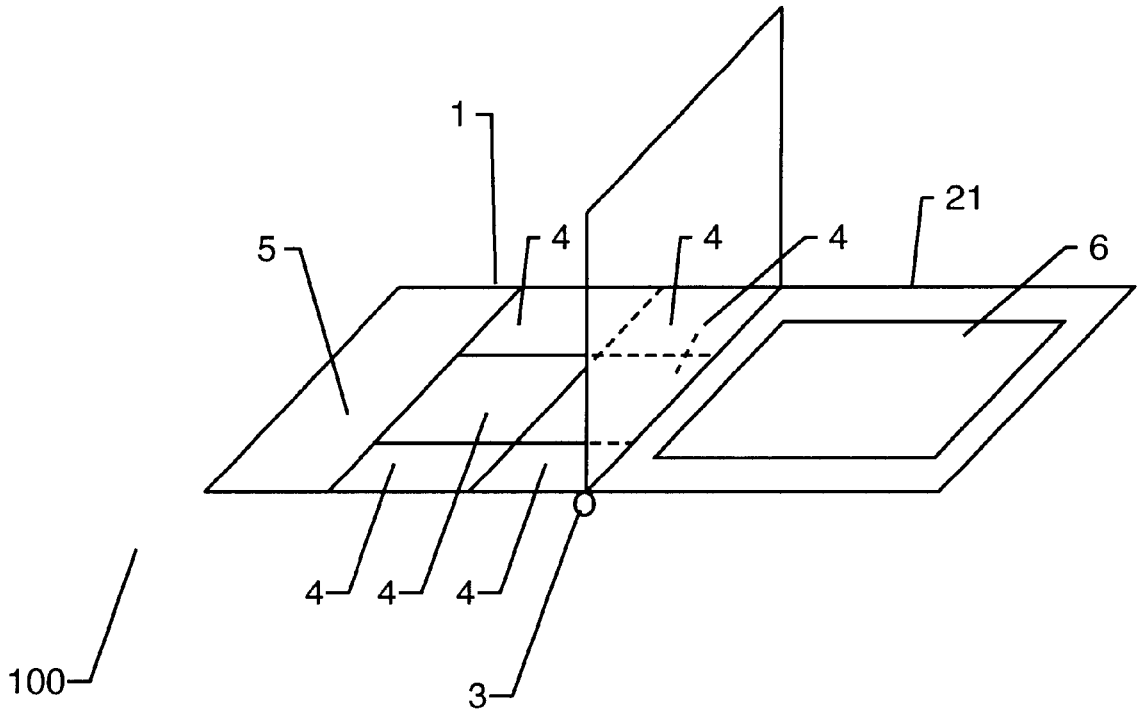
FIG.1 is a schematic picture showing a perspective view of a square embodiment of the make-up case of this invention (when opened).
Figure 2:
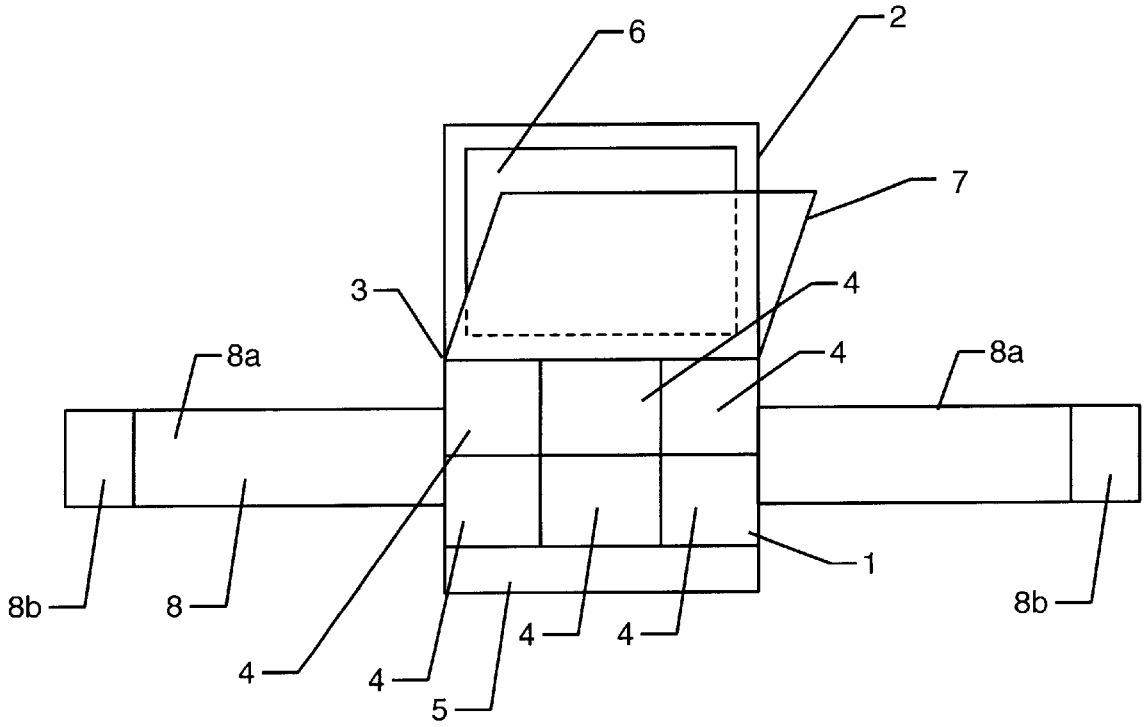
FIG. 2 is a schematic picture showing another perspective view of a square embodiment of the make-up case of this invention (when opened).

FIG. 1 and FIG. 2 illustrate a square embodiment of the make-up case of this invention in an open position. In this embodiment the case 100 is generally rectangular in shape, and preferably, a square. It comprises two compartments 1 and 2, connected with a hinge 3, so as to allow a reciprocal movement therebetween.

The compartment 1 is designed to hold inserts 4 preferably containing eye shadows, lip color concealer, mascara and other cosmetic supplies, except powder. Compartment 1 further comprises a brush holder section 5 designed to hold any kind of brush used in applying cosmetics. For example, section 5 can be split in two parts: one for an eye shadow brush and another for a lip brush, and a clip can be provided in the middle of section 5 (not shown) to hold the brush or brushes.

The combination of the supplies, as well as the choice of particular brushes can be made according to particular tastes and needs of the user. Those skilled in the art will choose a proper combination of inserts and brushes.

Compartment 2 comprises a tray 6 designed to hold compact powder. Any kind of powder ordinarily used can be placed in tray 6. Those skilled in the art will select proper powder which best suits their particular needs.

Compartments 1 and 2 are separated by a divider 7, connected to the make-up case by using the same hinge 3. At least one side of the divider 7 is preferably a reflective surface and either side of the divider can serve as a mirror. When the kit 100 is opened, compartments 1 and 2 are moved relatively to each other around the hinge 3, until they are positioned in the same plane, as shown on FIG. 1.

In such position, the divider 7 lies flat against the top surface of either compartment 1 (when the powder from compartment 2 is used) or compartment 2 (when the supplies from compartment 1 are used), as the case may be.

When the user applies the supplies from either compartment, she uses one surface of the divider 7 as a mirror. When the user has completed using the supplies from a compartment, she rotates the divider 7 on the hinge 3, covering this compartment and opening the other compartment (previously covered by the divider 7), followed by using the cosmetics from the other compartment. The other surface of the divider 7 can again be used as a mirror.

Compartments 1 and 2 can be made of any size as selected. However, the sizes of compartments 1 and 2 should be preferably substantially identical to allow the kit 100 to be safely closed.

In order to allow the divider 7 not to be smudged by the cosmetics supplies, recesses are preferably provided in compartments 1 and 2, so that when the divider 7 lies flat against a particular compartment 1 or 2 (or against both compartments 1 and 2 when not in use), it remains above the top surface of the supplies in inserts 4 or of the powder in the tray 6, respectively. Thus, by not touching the supplies, the divider 7 stays clean and free of marks, smudges and the like. Likewise, the brush section 5 is also provided with a recess, so that brushes in that section do not prevent the kit from being closed.

Figure 1A:
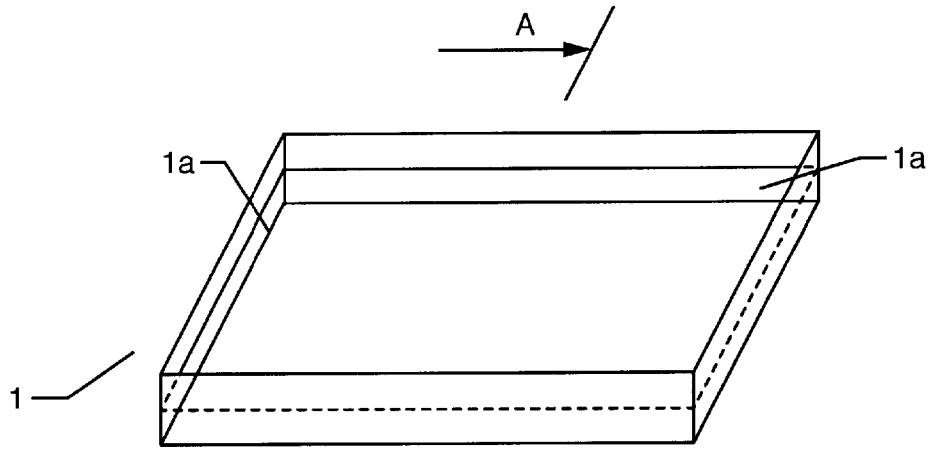
FIG. 1A is a schematic picture showing a top view of the bottom of a compartment of a square embodiment of the make-up case of this invention.
Figure 1B:
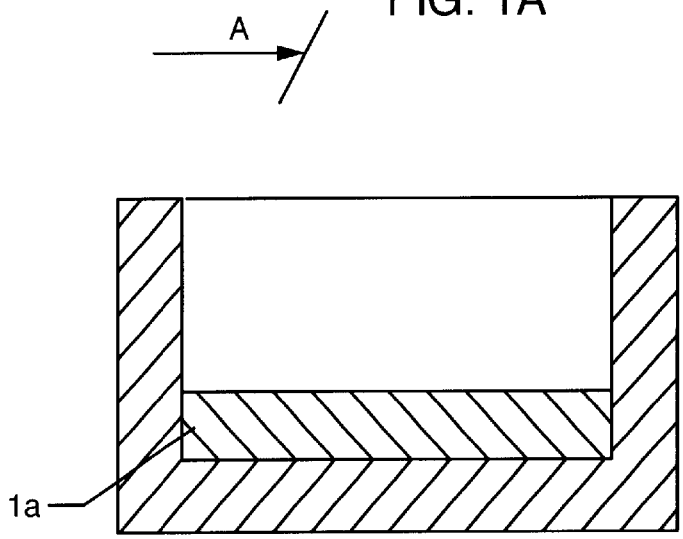
FIG. 1B is a schematic picture showing a cross-section view along the line A—A of the bottom of a compartment of a square embodiment of the make-up case of this invention.

The bottom of compartment 1 is lined with a thin layer 1*a* of a magnetic material, for instance, preferably stainless steel, or another suitable metal, as shown on FIGS. 1A and 1B.

Figure 1C:
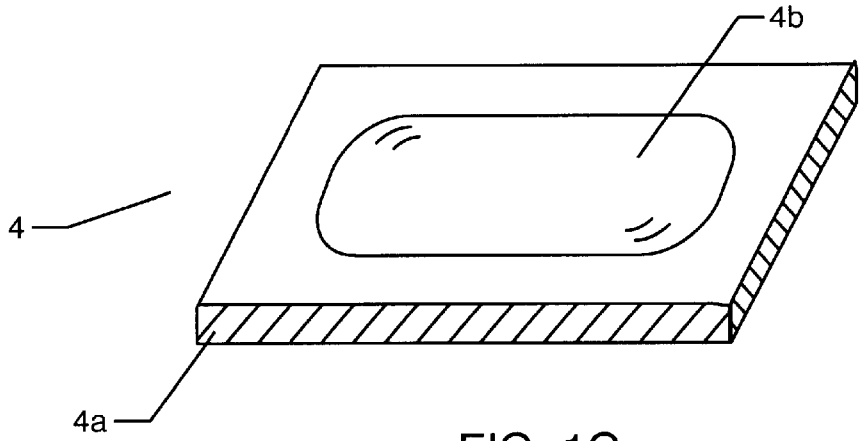
FIG. 1C is a schematic picture showing a magnetic insert which is able to contain the cosmetics supplies (not shown).

Each of the inserts 4 is a magnetic insert, substantially in a form of a parallelepiped, as shown in more detail in the enlarged partial view of FIG. 1C. Any suitable magnetic material can be used to make the inserts 4. The bottom surface 4*a* of each insert 4, therefore, sticks to the magnetic layer 1*a* on the bottom of compartment 1. Only the bottom surface 4*a* of the insert 4*a* needs to have magnetic properties.

Each insert 4 is filled with a particular kind of any desirable cosmetics (except powder) and is open from the side 4*b* allowing access to the cosmetics. Any number of inserts 4 can be used, depending on the size of the kit. Preferably, between six and nine inserts 4 are used. When the contents of an insert 4 are exhausted, the insert 4 is removed and disposed of, and a new filled-in insert 4 is put in the place of the used one.

Similarly, the tray 6 in compartment 2 is replaceable and when the powder in the tray 6 has been used up, the tray 6 is likewise removed and disposed of, and a new powder tray is put in the place of the used one.

FIG. 2 shows perspective view of the kit 100 from the top (when opened). The kit further comprises a belt 8, so as to enable the user to wear the kit 100 on her wrist or her ankle or pendent around the neck.

Figure 3:
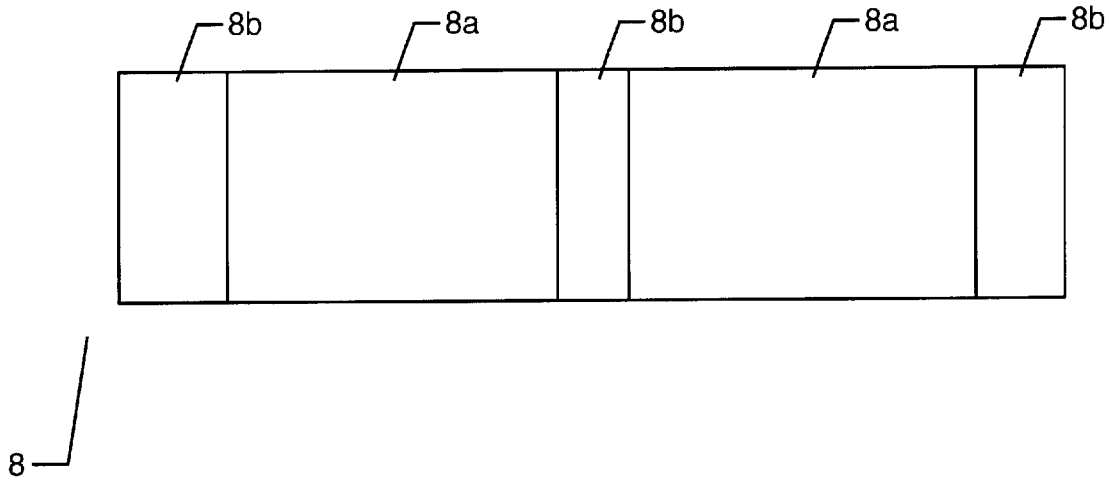
FIG. 3 is a schematic drawing showing a belt used in the make-up case of this invention.
Figure 4:
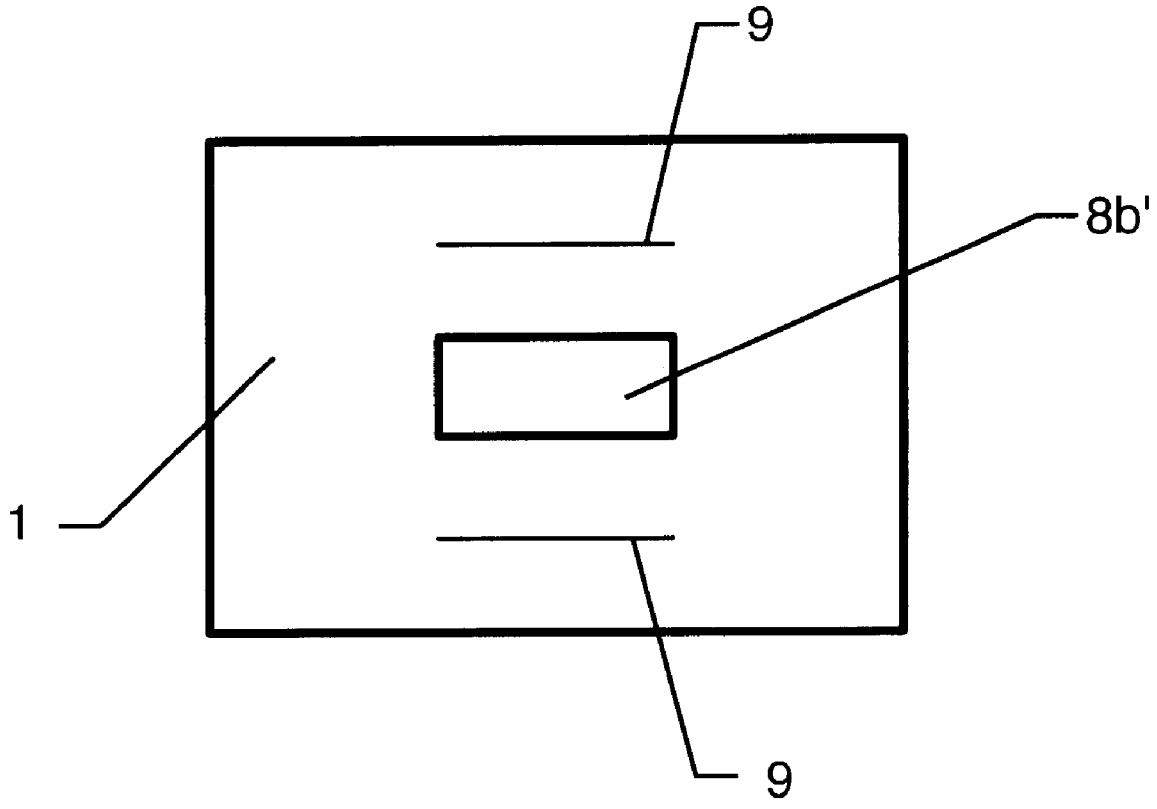
FIG. 4 is a schematic picture showing a bottom view of a compartments of a square embodiment of the make-up case of this invention.

The belt 8 comprises elastic sections 8*a* and VELCRO™, or hook and loop fastener, sections 8*b*, as shown in more detail on FIG. 3. As shown on the bottom view of the kit 100 of FIG. 4, which shows the kit in a closed condition, the belt 8 is inserted into two slots 9 formed in the bottom of the conpartment 1. The outer surface of the bottom of the compartment 1 comprises a VELCRO™, or hook and loop fastener, section 8*b* for matching with the intermediate section 8*b* of the belt 8. The slots for the belt can be also made in the bottom of compartment 2.

Other, equally preferred, embodiments of this invention comprise an oval and circular make-up cases. They are designed in way similar to that of the square embodiment with the differences described below.

Figure 5:
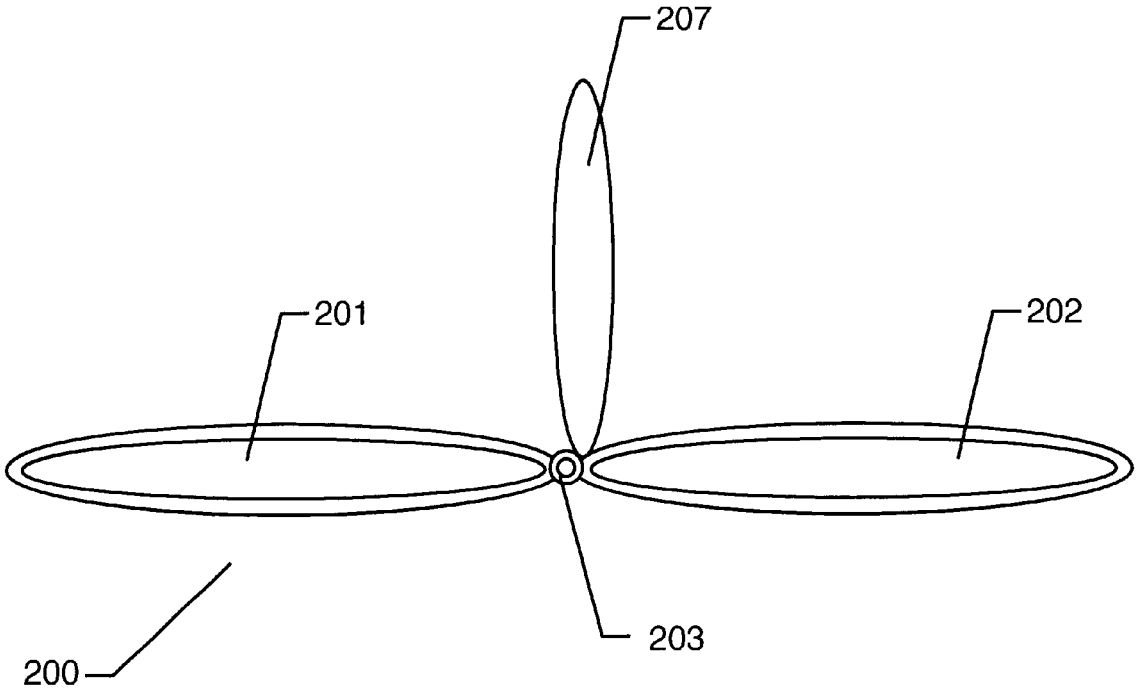
FIG. 5 is a schematic picture showing a perspective view of an oval embodiment of the make-up case of this invention (when opened).

A side view of an oval embodiment 200 of the make-up case is shown on FIG. 5. It comprises two compartments 201 and 202 connected with a hinge 203 and divided by a divider 207. Both compartments 201 and 202 and the divider 207 are oval-shaped. The purposes of the compartments 201 and 202 and the divider 207 are the same as in the square version of the make-up kit 100.

Figure 6:
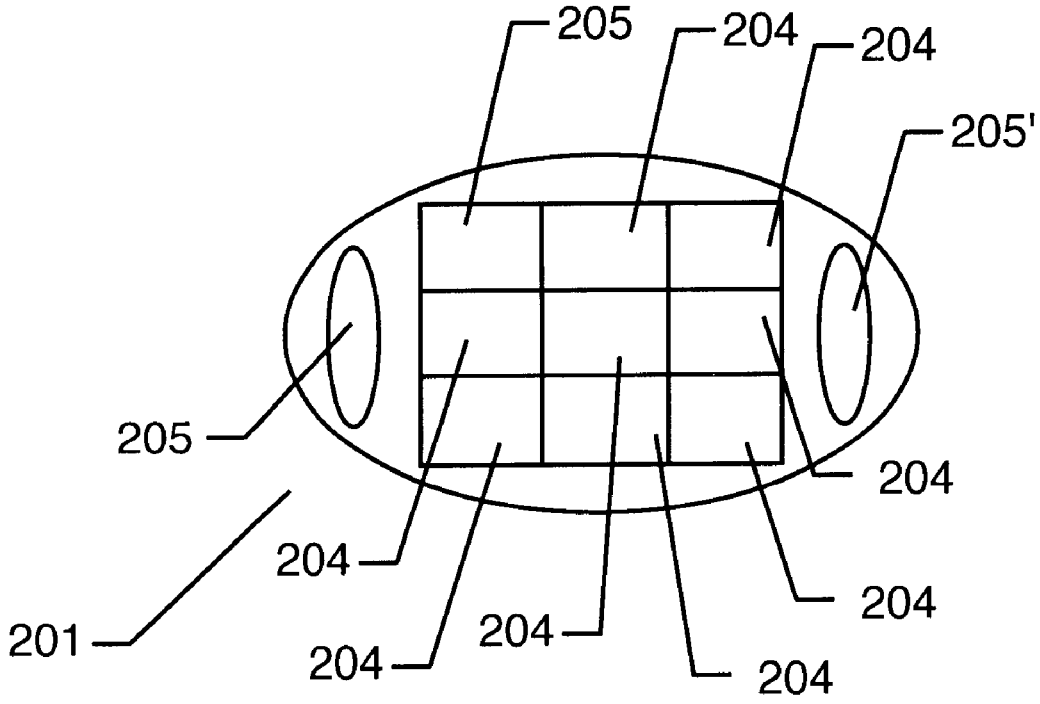
FIG. 6 is a schematic picture showing a top view of a compartment of an oval embodiment of the make-up case of this invention.

The compartment 201 in the oval embodiment differs somewhat from its counterpart 1 in the square embodiment. The difference is shown on FIG. 6. Instead of one brush section, the compartment 201 is provided with two separate brush sections, 205 and 205', for the shadow brush and for the lip brush. Otherwise, the structure of the make-up case is the same as for the square version, preferably including magnetic inserts 204 and magnetic lining on the bottom of compartment 201 (not shown).

Figure 7:
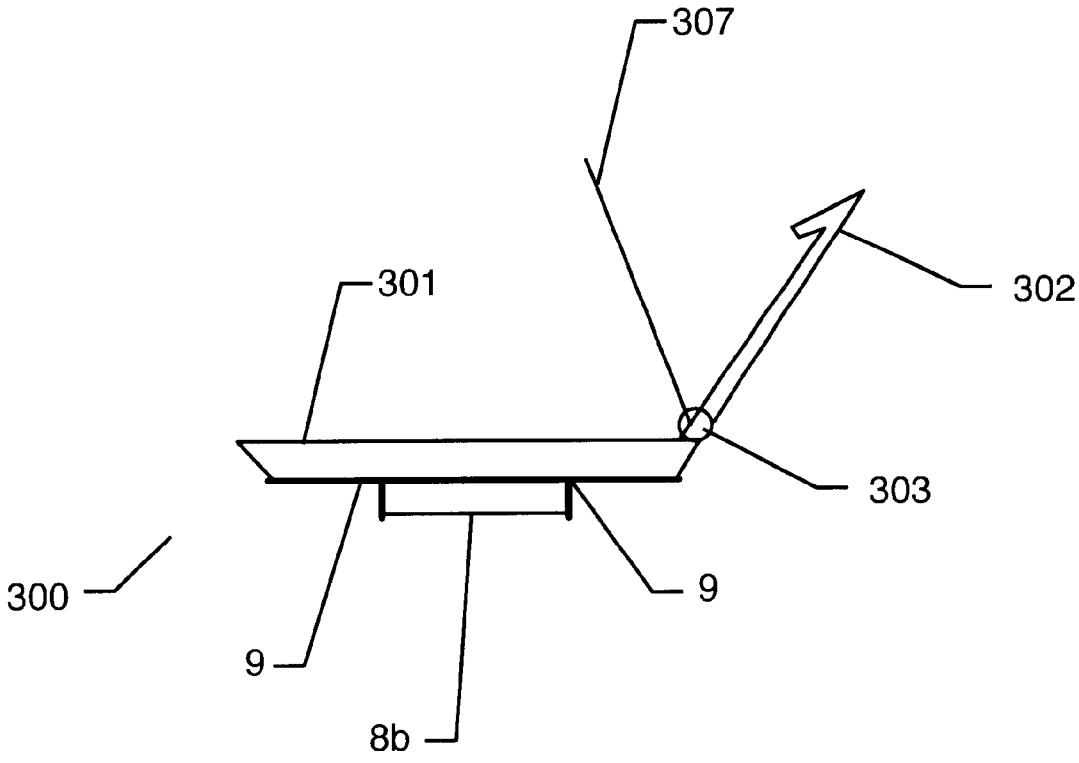
FIG. 7 is a schematic picture showing a perspective side view of a round embodiment of the make-up case of this invention (when opened).

A side view of the round embodiment 300 of the makeup case is shown on FIG. 7. Again, it comprises compartments 301 and 302 connected with a hinge 303 and includes a divider 307. Both compartments 301 and 302 and the divider 307 are round-shaped. The purposes of the compartment 301 and 302 and the divider 307 are the same as in the square version 100 and oval version 200 of the make-up kit. The VELCRO™, or hook and loop fastener, section 8*b* of the belt 8 inserted in slots 9 is also shown.

Figure 8:
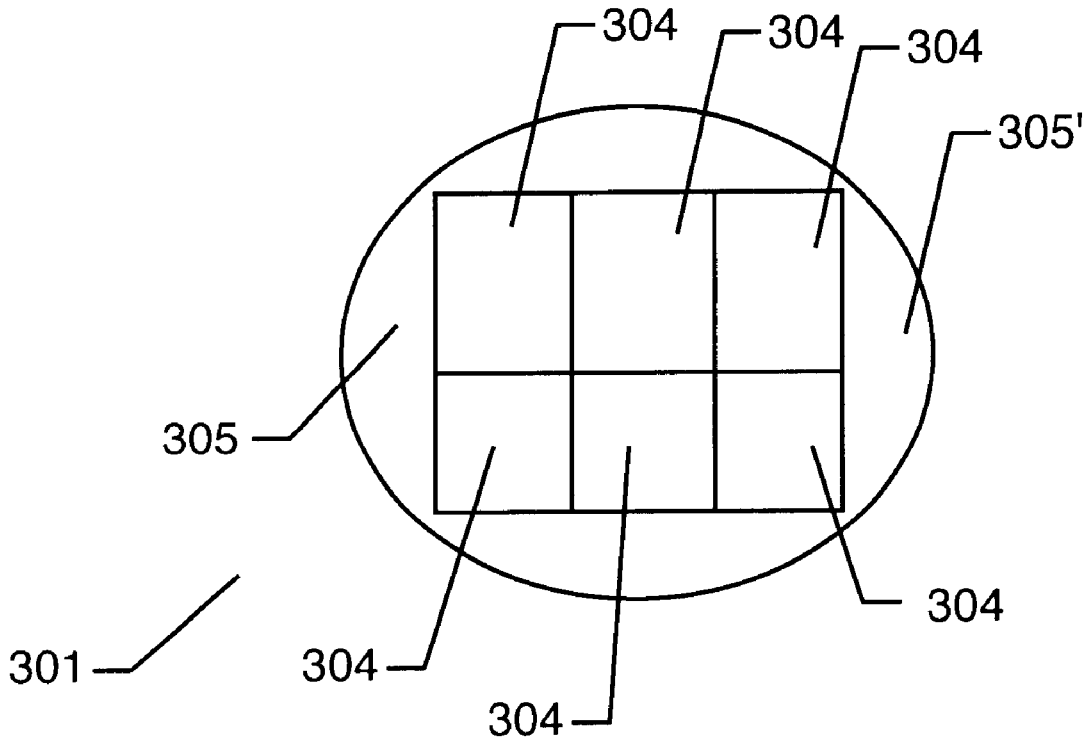
FIG. 8 is a schematic picture showing a top view of a compartment of a round embodiment of the make-up case of this invention.

The compartment 301 in the round embodiment 300 is very similar to the compartment 201 in the oval embodiment 200 but differs somewhat from its counterpart 1 in the square embodiment 100. The difference is shown on FIG. 8. Instead of one brush section 5 of the square embodiment 100, here, just as in the oval embodiment 200, there are two separate brush sections, 305 and 305' for the shadow brush and for the lip brush. Otherwise, the structure of the make-up case here is the same as for the square version 100 or oval version 200, including magnetic inserts 304 and magnetic lining on the bottom of compartment 301 (not shown).

Figure 9:
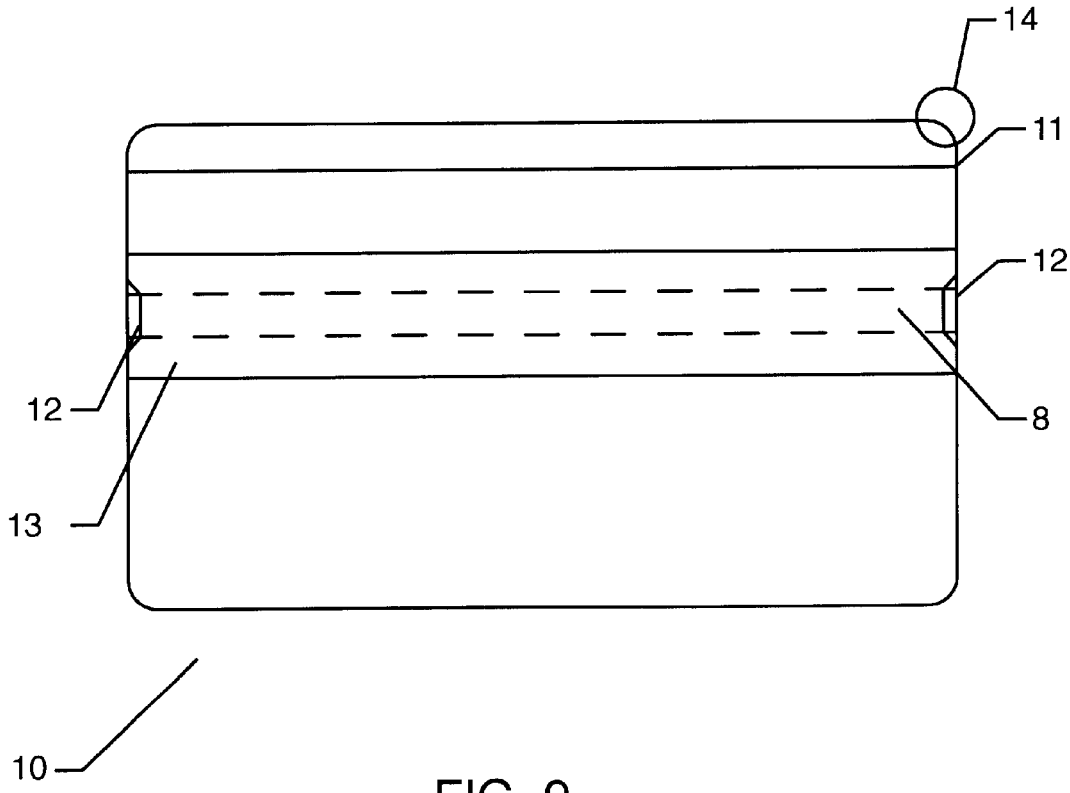
FIG. 9 is a schematic picture showing a pouch that can be attached to the make-up case of this invention.

Optionally, a pouch 10 shown in FIG. 9, can be attached to any embodiment of the make-up case of this invention. The pouch 10 is intended for keeping money, keys, and similar items. The pouch 10 is made of leather or other suitable material and comprises a zipper, 11, or, alternatively, a velcro strip 13, in order to be securely closed.

The pouch 10 also comprises two slots 12 enabling the wearer to insert the belt 8 and thus to attach the pouch 10 to the make-up case. A key ring 14 is also optionally provided. The pouch 10 can be of any color to match that of the make-up case.

The body of the make-up kit in any embodiment is preferably made of a sturdy and durable plastic to be selected by those skilled in the art. The belt 8 can be chosen of any color, and a holograph or a piece of jewelry can be optionally attached to the case.

Having described the present invention in connection with several embodiments thereof, modification will now suggest itself to those skilled in the art. As such, the invention is not to be limited to the described embodiments except as required by the appended claims.

I claim:

1. A case for carrying and storing cosmetics supplies comprising:

(a) a first compartment, a second compartment and a hinge connecting the first compartment with the second compartment, wherein said case is opened and closed by rotating either of said compartments about said hinge, said first compartment said second compartment, and said dividing element have same shape, said shape being selected from the group consisting of rectangular, oval, and circular, said first compartment comprises a bottom surface having an inner portion and an outer portion, the inner portion of said bottom surface being lined with a magnetic material, said first compartment comprises at least one section to hold brushes, said second compartment contains a removable tray with compact powder, said case is made of a plastic material;

(b) a dividing element inserted between said first compartment and said second compartment, and hingedly held in place, wherein said dividing clement has a first side and a second side, and being rotatable about said hinge, wherein said dividing element comprises a first surface and a second surface, at least one of said first and second surface being made of reflective material, to enable said dividing element to be used as a mirror;

(c) a plurality of magnetic holders of said cosmetics supplies removably disposed inside said first compartment, wherein said magnetic holders contain non-powder cosmetics supplies;

(d) a belt said belt being secured to a bottom of either of said compartments, wherein said belt allows a user to wear said case around said user's wrist, neck, or ankle, wherein said belt comprises alternating elastic and velcro sections; and (e) a pouch for carrying valuables, wherein said pouch is attached to said case with said belt, wherein said pouch comprises two slots, said belt being inserted in said two slots, wherein the bottom of either one of said first compartment and said second compartment comprises a compartment hook and loop fastener section and said belt comprises a plurality of hook and loop fastener sections, one of said belt hook and loop fastener sections cooperating with said compartment hook and loop fastener section to connect the case to the belt.

* * * * *